US005858932A

United States Patent [19]

Dasai et al.

[11] Patent Number: 5,858,932

[45] Date of Patent: Jan. 12, 1999

[54] INTERNAL COMBUSTION ENGINE OIL COMPOSITION

[75] Inventors: Masashi Dasai; Masahiko Kido; Hiroshi Fujita, all of Ichihara, Japan

[73] Assignee: Idemitsu Kosan Co., Ltd., Tokyo, Japan

[21] Appl. No.: 944,782

[22] Filed: Oct. 6, 1997

[30] Foreign Application Priority Data

Oct. 11, 1996 [JP] Japan ..... 8-269521

[51] Int. Cl.[6] ..... C10M 111/00

[52] U.S. Cl. ..... 508/371; 508/591; 585/13

[58] Field of Search ..... 508/371

[56] References Cited

U.S. PATENT DOCUMENTS

| | | | |
|---|---|---|---|
| 3,151,075 | 9/1964 | Butler | 508/371 |
| 3,293,181 | 12/1966 | Stuart | 508/371 |
| 3,347,790 | 10/1967 | Meinhardt | 508/371 |
| 3,442,804 | 5/1969 | LeSuer et al. | 508/371 |
| 3,450,636 | 6/1969 | Rausch | 508/371 |
| 4,528,108 | 7/1985 | Grover | 508/371 |
| 5,604,188 | 2/1997 | Ryan | 508/371 |
| 5,688,748 | 11/1997 | Tomizawa | 508/371 |

*Primary Examiner*—Ellen M. McAvoy
*Attorney, Agent, or Firm*—Oblon, Spivak, McClelland, Maier & Neustadt, P.C.

[57] ABSTRACT

Lubricating oil composition for internal combustion engines includes a base oil containing (A) 30–98% by weight of a mineral oil having a kinematic viscosity of 2–30 $mm^2$/sec at 100° C. and a viscosity index of not less than 100 and (B) 2–70% by weight of poly-α-olefin, and zinc dithiophosphate in an amount corresponding, as reduced to the amount of P (phosphorus), to 0.02–0.15 parts by weight with respect to 100 parts by weight of the base oil. The composition of the present invention is advantageously used as lubricating oil composition for internal combustion engines, exerting excellent effects in terms of the consumption of the oil composition, fuel consumption rate, and sealing characteristics of rubber.

10 Claims, No Drawings

INTERNAL COMBUSTION ENGINE OIL COMPOSITION

BACKGROUND OF THE INVENTION

1. Field of the Invention

The present invention relates to lubricating oil composition for internal combustion engines, and more particularly to lubricating oil composition for internal combustion engines which is consumed in a reduced amount in internal combustion engines and realizes excellent fuel consumption characteristics (fuel cost) and rubber sealing characteristics. The invention also relates to a method for lubricating an internal combustion engine through use of such an oil composition.

2. Background Art

Lubricating oil, which is used at the interface of the pistons and cylinders of internal combustion engine, is consumed together with fuel during operation of the internal combustion engine. Generally speaking, the consumption of the lubricant oil increases as the engine speed or output power of the internal combustion engine increases. One preferable measure to reduce the consumption of lubricant oil may be to use an oil having as high a viscosity as possible.

In the meantime, when lubricant oil having high viscosity is used, the fuel consumption of internal combustion engines increases due to friction loss and power loss, resulting in an increase of fuel consumption rate. Also, sealing characteristics of rubber may sometimes be degraded.

Under the above circumstances, in order to reduce consumption of lubricant oils and to maintain or improve the sealing characteristics of rubber, a variety of lubricant oils, such as those containing certain types of lubricant base oils for the purpose of adjusting viscosity and those containing a variety of additives, have been developed for use with internal combustion engines and put into practical use.

However, since lubricant oils that have conventionally been developed and used for internal combustion engines do not satisfy all of the aforementioned requirements, there still remains the need for lubricant oil for internal combustion engines, or internal combustion engine oil, which simultaneously satisfies all the above requirements.

The present inventors have conducted careful studies to attain the above object and have found that the object is effectively attained by a composition comprising a base oil and a specified additive, the base oil containing (A) a mineral oil having a specified viscosity and (B) poly-α-olefin, which is one type of a synthetic oil.

Hitherto, there have been known lubricating oil composition for internal combustion engines which is made up of one or more species of mineral oils in admixture (for example, Japanese Patent Application Laid-Open (kokai) No. 64-6094), and another type of lubricating oil composition for internal combustion engines which contains poly-α-olefin (B) in combination with other polymers (for example, Japanese Patent Application Laid-Open (kokai) No. 59-89397). With the state of the art being as described above, the present inventors have found that use of a specified mineral oil (A) and a poly-α-olefin (B) in combination can effectively attain the aforementioned goals, i.e, reduction in the consumption of the engine oil, improvements of fuel consumption rate, etc. The present invention was accomplished based on this epoch-making finding.

SUMMARY OF THE INVENTION

Accordingly, an object of the present invention is to provide lubricating oil composition for internal combustion engines comprising a base oil containing (A) 30–98% by weight of a mineral oil having a kinematic viscosity of 2–30 $mm^2$/sec at 100° C. and a viscosity index of not less than 100 and (B) 2–70% by weight of poly-α-olefin, and zinc dithiophosphate in an amount corresponding, as reduced to the amount of P (phosphorus), to 0.02–0.15 parts by weight with respect to 100 parts by weight of the base oil.

Preferably, the kinematic viscosity of poly-α-olefin at 100° C. is 2–30 $mm^2$/sec.

Preferably, the poly-α-olefin is a polymer of at least one α-olefin selected from the group consisting of octene-1, nonene-1, decene-1, and dodecene-1.

Preferably, the amount of zinc dithiophosphate is 0.04–0.12 parts by weight as reduced to the amount of P (phosphorus) with respect to 100 parts by weight of the base oil.

The lubricant oil composition of the present invention may further comprise 0.1–20 parts by weight of a viscosity index improver with respect to 100 parts by weight of the base oil.

DETAILED DESCRIPTION OF THE PREFERRED EMBODIMENTS

The mineral oil (A) used in the present invention has a kinematic viscosity of 2–30 $mm^2$/sec at 100° C., and a viscosity index of 100 or more. When the kinematic viscosity at 100° C. is less than 2 $mm^2$/sec, the lubricant oil significantly evaporates, whereas when it is in excess of 30 $mm^2$/sec, power loss increases considerably due to viscous resistance, both cases being not preferable. Mineral oils having a viscosity index of less than 100 are not suitable for use as components of lubricating oil composition for internal combustion engines, as temperature dependence of the viscosity change of the lubricant oil becomes considerable. The viscosity index is preferably from 100 to 150, and particularly preferably from 110 to 140.

A variety species of mineral oil (A) may be used in the present invention so long as they have the aforementioned properties. Illustrative examples of the mineral oils may be obtained by hydrogenating (particularly hydrocracking under severe conditions) a distillate, deasphalted oil, or slack wax which are obtained through distillation under atmospheric pressure or reduced pressure of different crude oils such as paraffin base crude oils and intermediate base crude oils; distilating the resultant material if desired; and subsequently dewaxing (solvent dewaxing and/or hydrogenation dewaxing) the resultant material.

The mineral oils may be used singly or in combination. When two or more species of mineral oils are used, it is generally preferred that each mineral oil has a viscosity index of 100 or more. However, mineral oils having a viscosity index of not less than 100 and mineral oils having a viscosity index of less than 100 may be used in admixture, so long as the resultant mineral oil mixture has a viscosity index of not less than 100.

In this connection, if the mineral oils are treated with sulfuric acid, clay, etc., to remove basic nitrogen components contained therein, the effect of the present invention is further improved.

Poly-α-olefin (B) used in the present invention is obtained by subjecting α-olefin to cationic polymerization or radical polymerization through use of a variety of catalysts such as Ziegler catalyst, aluminum chloride catalyst, or a catalyst formed of boron trifluoride and an alcohol. Generally, poly-α-olefin (B) is an oligomer larger than trimers. Poly-α-olefin (B) preferably has a kinematic viscosity of 2–30 $mm^2$/sec at 100° C., and more preferably 3–15 $mm^2$/sec. This is because when the kinematic viscosity is less than 2 $mm^2$/sec, the lubricant oil significantly evaporates, whereas when it is in excess of 30 $mm^2$/sec, power loss considerably increases due to viscous resistance.

Preferred poly-α-olefins are those obtained from polymerization of one or more starting α-olefins having 2–16, more preferably 8–12, carbon atoms. Specific examples of α-olefins include ethylene, propylene, butene-1, pentene-1, hexene-1, heptene-1, octene-1, nonene-1, decene-1, undecene-1, and dodecene-1. Of these, octene-1, nonene-1, decene-1, and dodecene-1 are particularly preferred.

The amounts of mineral oil (A), which serves as a base oil of the present invention, and poly-α-olefin (B) are such that mineral oil (A) is from 30–98% by weight and poly-α-olefin (B) is 2–70% by weight. Preferably, mineral oil (A) is from 40–98% by weight and poly-α-olefin is 2–60% by weight. More preferably, mineral oil (A) is from 60–95% by weight and poly-α-olefin (B) is 5–40% by weight. When mineral oil (A) is used in an amount of less than 30% by weight, rubber becomes hardened, resulting in poor sealing characteristics. On the other hand, when the amount of mineral oil (A) is in excess of 98% by weight, oil consumption tends to increase. Therefore, these two cases should be avoided.

In the present invention, zinc dithiophosphate (Zn—DTP) is added to the base oil.

Zinc dithiophosphate has been widely put on the market as an agent for imparting lubricant base with various functions such as those of antioxidants, abrasion preventive agents, extreme pressure additives, and anticorrosive agents. This compound is generally represented by $Zn\,[P(OR)_2S_2]_2$, wherein R represents a hydrogen atom or a hydrocarbon group such as alkyl, aryl, etc. Of alkyl groups, preferred ones are those having 1–6 carbon atoms, such as methyl, ethyl, n-propyl, i-propyl, n-butyl, i-butyl, n-pentyl, and i-pentyl; and more preferably secondary alkyl groups such as i-propyl, n-butyl, and i-pentyl.

The amount of zinc dithiophosphate is from 0.02 to 0.15, preferably from 0.04 to 0.12, parts by weight with respect to 100 parts by weight of the aforementioned base oil formed of mineral oil (A) and poly-α-olefin (B), when calculated in terms of the amount of P (phosphorus). Amounts of less than 0.02 parts by weight do not afford the effect of the additive, whereas amounts in excess of 0.15 parts by weight invite problems such as toxicity on catalysts for purifying exhaust emission and on $O_2$ sensors.

In the present invention, viscosity index improvers may further be incorporated when needed, to thereby improve the viscosity index of the base oil formed of mineral oil (A) and poly-α-olefin (B) to a desired level.

Viscosity index improvers which are used in the present invention are suitably selected from among conventional ones which include polyacrylate, polymethacrylate, polyisobutylene, polyolefin, polyolefin copolymers (for example, ethylene-propylene copolymers), polyalkyl styrene (for example, polystyrene, poly-α-methylstyrene), phenolic condensates, naphthalic condensates, and styrene-butadiene copolymers. Of these, poly(meth)acrylate is preferred.

Specific examples of poly(meth)acrylates include those having 1–20 alkyl groups (e.g., polymethyl(meth)acrylate, polyethyl(meth)acrylate, polypropyl(meth)acrylate, polybutyl(meth)acrylate, polypentyl(meth)acrylate, polyhexyl(meth)acrylate, polyheptyl(meth)acrylate, polyoctyl(meth)acrylate, polydecyl(meth)acrylate, polylauryl(meth)acrylate, polytridecyl(meth)acrylate, polytetradecyl(meth)acrylate, polyhexadecyl(meth)acrylate, polyoctadecyl(meth)acrylate); and those having 21–24 alkyl groups such as (meth)acrylates of higher alcohols. These species of poly(meth)acrylate may be advantageously used after being copolymerized with 3–8% by weight, preferably 4–6% by weight, of N,N-dialkylaminoalkyl(meth)acrylate. Examples of preferred species of the counterpart component of copolymerization, N,N-dialkylaminoalkyl(meth)acrylate, include N,N-dimethylaminoethyl(meth)acrylate, N,N-dimethylaminopropyl(meth)acrylate, N,N-diethylaminohexyl(meth)acrylate, and N,N-dibutylaminooctyl(meth)acrylate. These (meth)acrylate compounds may be used singly or in combination of two or more.

The viscosity index improver is preferably used in an amount of 0.1–20 parts by weight, preferably 1–15 parts by weight, with respect to 100 parts by weight of the base oil formed of mineral oil (A) and polyα-olefin (B). When the amount of the viscosity improver is less than 0.1 part by weight, no viscosity index improving effect can be obtained. Conversely, when the amount is in excess of 20 parts by weight, the viscosity index becomes excessively high, resulting in increased friction loss and power loss, leading to an increase of fuel consumption, or the fuel consumption rate, of internal combustion engines.

In the present invention, there may be used a variety of additives which are generally incorporated into internal combustion engine oils, such as metallic detergents, ashless dispersants, rust preventives, antiwear agents, pour point depressants, antioxidants, and friction modifiers.

The present invention will next be described by way of example.

EXAMPLES

Examples 1 and 2, and Comparative Examples 1 and 2

Internal combustion engine oil compositions were prepared through use of the ingredients having properties shown in Table 1. The oil consumption and sealing characteristics of rubber were measured or observed. The lubricant oil consumption was measured in accordance with JPI 55-41-93 (the Japan Petroleum Institute). Fuel consumption rates of not more than 22% by weight were taken as preferable ranges (or values), whereas rates in excess of 22% by weight were taken as "not preferable" ranges (or values). Sealing characteristics of rubber were determined by measuring the change of hardness (degree of swelling) of nitrile rubber in accordance with JIS K6301. Positive numerical figures indicate hardening of rubber, whereas negative ones indicate softening of rubber. Sealing characteristics can be assessed by use of absolute values of the measurements of change of hardness, and absolute values closer to "0" indicate more preferred results, with the absolute value "0" being the best result.

It is well known that fuel consumption characteristics are greatly affected by grades of viscosity, types of viscosity index improvers, and presence or absence of friction modifiers. Accordingly, in order to clearly distinguish the effect attributed to the combination of mineral oil (A) and poly-α-olefin (B), measurement conditions were consolidated through use of a single type of viscosity index improver, without use of friction modifiers, so as to adjust kinematic viscosity of each lubricant oil composition to 10 $mm^2$/sec at 100° C. and the CCS viscosity to 3,000 mPa·s at −25° C.

TABLE 1

| Composition/properties | | Ex. 1 | Ex. 2 | Comp. Ex. 1 | Comp. Ex. 2 |
|---|---|---|---|---|---|
| Mineral oil | (A1): % by weight<br>Viscosity index: 115<br>Kinematic viscosity (100° C.): 4 $mm^2$/sec | 50 | 60 | | |
| | (A1): % by weight<br>Viscosity index: 105<br>Kinematic viscosity (100° C.): 5 $mm^2$/sec | 40 | | | |
| | (A1): % by weight<br>Viscosity index: 95<br>Kinematic viscosity (100° C.): 4 $mm^2$/sec | | 20 | | 90 |
| | Viscosity index of the entirety of the mineral oil | 112 | 108 | — | 95 |
| Poly-α-olefin (1-decene oligomer): % by weight<br>Kinematic viscosity (100° C.): 6 $mm^2$/sec | | 10 | 20 | 100 | 10 |
| Zn-DTP | | 1 | 1 | 1 | 1 |
| Viscosity index improver: Parts by weight (Polymethacrylate) | | 3 | 3 | 1.5 | 4 |
| Effect | Oil consumption: % by weight [evaporation: 250° C., 1 hr] | 15 | 17 | 5 | 25 |
| | Sealing characteristics of rubber<br>Volume change rate of rubber [120° C., 70 hrs.] | 0 | −1 | +4 | −2 |

Example 3 and Comparative Example 3

Internal combustion engine oil compositions were prepared through use of the ingredients having properties shown in Table 2. The procedure of Example 1 was repeated except that the kinematic viscosity of each oil composition was adjusted to 10 $mm^2$/sec at 100° C. and the CCS viscosity was adjusted to 3,000 mPa·s at −30° C., and fuel consumption characteristics and sealing properties of rubber were determined.

TABLE 2

| Composition/properties | | Ex. 3 | Comp. Ex. 3 | Ex. 4 | Comp. Ex. 4 |
|---|---|---|---|---|---|
| Mineral oil | (A1): % by weight<br>Viscosity index: 115<br>Kinematic viscosity (100° C.): 4 $mm^2$/sec | 40 | | 50 | |
| | (A1): % by weight<br>Viscosity index: 105<br>Kinematic viscosity (100° C.): 5 $mm^2$/sec | | | 40 | 40 |
| | (A1): % by weight<br>Viscosity index: 90<br>Kinematic viscosity (100° C.): 3 $mm^2$/sec | | 90 | | 50 |
| | Viscosity index of the entirety of the mineral oil | 112 | 90 | — | 98 |
| Poly-α-olefin (1-decene oligomer): % by weight<br>Kinematic viscosity (100° C.): 4 $mm^2$/sec | | 60 | 10 | 100 | 10 |
| Zn-DTP | | 1 | 1 | 1 | 1 |
| Viscosity index improver: Parts by weight (Polymethacrylate) | | 6 | 7 | 4 | 5 |
| Effect | Oil consumption: % by weight [evaporation: 250° C., 1 hr] | 13 | 40 | 15 | 31 |
| | Sealing characteristics of rubber<br>Volume change rate of rubber [120° C., 70 hrs.] | −1 | −2 | 0 | −3 |

Example 4 and Comparative Example 4

Internal combustion engine oil compositions were prepared through use of the ingredients having properties shown in Table 2. The procedure of Example 1 was repeated except that the kinematic viscosity of each oil composition was adjusted to 8.7 $mm^2$/sec at 100° C. and the CCS viscosity was adjusted to 3,000 mPa·s at −25° C., and fuel consumption characteristics and sealing properties of rubber were determined.

As described hereinabove, when a specified type of mineral oil (A) and a specified type of poly-α-olefin (B) are used in combination in a specified ratio, and the resultant base oil is further combined with a specified amount of zinc dithiophosphate, there can be obtained a composition suitable for use as lubricating oil composition for internal combustion engines, exerting excellent effects in terms of the consumption of the oil composition, fuel consumption rate, and sealing characteristics of rubber.

What is claimed is:

1. Lubricating oil composition for internal combustion engines comprising a base oil containing (A) 30–98% by weight of a mineral oil having a kinematic viscosity of 2–30 $mm^2$/sec at 100° C. and a viscosity index of not less than 100 and (B) 2–70% by weight of poly-α-olefin, and zinc dithiophosphate in an amount corresponding, as reduced to the amount of P (phosphorus), to 0.02–0.15 parts by weight with respect to 100 parts by weight of the base oil.

2. Lubricating oil composition for internal combustion engines according to claim 1, wherein the kinematic viscosity of poly-α-olefin at 100° C. is 2–30 $mm^2$/sec.

3. Lubricating oil composition for internal combustion engines according to claim 1, wherein the poly-α-olefin is a polymer of at least one α-olefin selected from the group consisting of octene-1, nonene-1, decene-1, and dodecene-1.

4. Lubricating oil composition for internal combustion engines according to claim 1, wherein the amount of zinc dithiophosphate is 0.04–0.12 parts by weight as reduced to the amount of P (phosphorus) with respect to 100 parts by weight of the base oil.

5. Lubricating oil composition for internal combustion engines according to claim 1, further comprising 0.1–20 parts by weight of a viscosity index improver with respect to 100 parts by weight of the base oil.

6. Lubricating oil composition for internal combustion engines according to claim 2, further comprising 0.1–20 parts by weight of a viscosity index improver with respect to 100 parts by weight of the base oil.

7. Lubricating oil composition for internal combustion engines according to claim 3, further comprising 0.1–20 parts by weight of a viscosity index improver with respect to 100 parts by weight of the base oil.

8. Lubricating oil composition for internal combustion engines according to claim 4, further comprising 0.1–20 parts by weight of a viscosity index improver with respect to 100 parts by weight of the base oil.

9. Lubricating oil for internal combustion engines according to claim 1, wherein the mineral oil has a kinematic viscosity of 5–30 $mm^2$/sec at 100° C.

10. Lubricating oil for internal combustion engines according to claim 1, wherein the mineral oil has a kinematic viscosity of 2–5 $mm^2$/sec at 100° C.

* * * * *